US010337748B2

(12) United States Patent
Watanabe et al.

(10) Patent No.: US 10,337,748 B2
(45) Date of Patent: Jul. 2, 2019

(54) MUFFLER FOR AIR-CONDITIONING APPARATUS AND AIR-CONDITIONING APPARATUS INCLUDING THE SAME

(71) Applicant: Mitsubishi Electric Corporation, Tokyo (JP)

(72) Inventors: Masayuki Watanabe, Tokyo (JP); Yoshiyuki Tada, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 15/503,047

(22) PCT Filed: Oct. 1, 2015

(86) PCT No.: PCT/JP2015/077953
§ 371 (c)(1),
(2) Date: Feb. 10, 2017

(87) PCT Pub. No.: WO2016/063705
PCT Pub. Date: Apr. 28, 2016

(65) Prior Publication Data

US 2017/0234552 A1 Aug. 17, 2017

(30) Foreign Application Priority Data

Oct. 20, 2014 (JP) ..... 2014-213880

(51) Int. Cl.
*F24F 1/12* (2011.01)
*F04B 39/00* (2006.01)
(Continued)

(52) U.S. Cl.
CPC ..... *F24F 1/12* (2013.01); *F01N 1/02* (2013.01); *F04B 39/00* (2013.01);
(Continued)

(58) Field of Classification Search
CPC ..... F24F 1/12; F24F 13/24; F24F 2013/245; F25B 41/00; F25B 2500/12; F04B 39/0055; Y10S 181/403
(Continued)

(56) References Cited

U.S. PATENT DOCUMENTS 4,122,914 A * 10/1978 Suyama ..... F01N 1/02 181/258

FOREIGN PATENT DOCUMENTS

JP S50-38511 U 8/1973
JP 59-021951 A 2/1984
(Continued)

OTHER PUBLICATIONS

International Search Report of the International Searching Authority dated Dec. 15, 2015 for the corresponding international application No. PCT/JP2015/077953 (and English translation).
(Continued)

*Primary Examiner* — Joseph F Trpisovsky
(74) *Attorney, Agent, or Firm* — Posz Law Group, PLC

(57) ABSTRACT

Provided is a muffler for an air-conditioning apparatus, which is compact and has a small pressure loss, and an air-conditioning apparatus including the same. The muffler for an air-conditioning apparatus including a muffler main body which has small diameter portions on an inlet side and an outlet side, the small diameter portions having inner diameters smaller than an inner diameter of a central portion of the muffler main body, an inlet pipe connected to the small diameter portion on the inlet side of the muffler main body; and an outlet pipe connected to the small diameter portion on the outlet side of the muffler main body. The inlet pipe is inserted into the muffler main body, and has a distal end positioned at a center of a length from an inlet to an outlet of the muffler main body. The distal end side of the inlet pipe
(Continued)

inserted into the muffler main body has an inner diameter smaller than an inner diameter of the inlet pipe on an upstream of the distal end side.

4 Claims, 5 Drawing Sheets

(51) Int. Cl.

| | |
|---|---|
| ***F01N 1/02*** | (2006.01) |
| ***F25B 41/00*** | (2006.01) |
| *F04C 29/06* | (2006.01) |
| *F24F 13/24* | (2006.01) |

(52) U.S. Cl.
CPC ..... *F04B 39/0055* (2013.01); *F04B 39/0061* (2013.01); *F25B 41/00* (2013.01); *F04C 29/06* (2013.01); *F24F 2013/245* (2013.01); *F25B 2500/12* (2013.01)

(58) Field of Classification Search
USPC ..... 62/296
See application file for complete search history.

(56) References Cited

FOREIGN PATENT DOCUMENTS

| | | | |
|---|---|---|---|
| JP | 4-85076 | U | 7/1992 |
| JP | 04-292518 | A | 10/1992 |
| JP | 09-203386 | A | 8/1997 |
| JP | 2011-012869 | A | 1/2011 |
| JP | 2013-060912 | A | 4/2013 |

OTHER PUBLICATIONS

Office Action dated Aug. 23, 2016 in the corresponding JP application No. 2014-213880 (and English translation).
Extended European Search Report dated May 9, 2018 issued in corresponding EP patent application No. 15852412.4.
Office action dated Jul. 23, 2018 issued in corresponding CN patent application No. 201580043791.9 (and English translation thereof).
Office Action dated Dec. 13, 2018 issued in corresponding Chinese patent application No. 201580043791.9 (and English translation).
Observations by Third Parties dated Dec. 10, 2018 issued in corresponding EP patent application No. 15852412.4.

* cited by examiner

MUFFLER FOR AIR-CONDITIONING APPARATUS AND AIR-CONDITIONING APPARATUS INCLUDING THE SAME

CROSS REFERENCE TO RELATED APPLICATIONS

This application is a U.S. national stage application of PCT/JP2015/077953 filed on Oct. 1, 2015, which claims priority to Japanese Patent Application No. 2014-213880 filed on Oct. 20, 2014, the contents of which are incorporated herein by reference.

TECHNICAL FIELD

The present invention relates to a muffler for an air-conditioning apparatus and an air-conditioning apparatus including the muffler for an air-conditioning apparatus.

BACKGROUND ART

In general, a refrigerant circuit of an air-conditioning apparatus includes a compressor, a condenser, an expansion valve, and an evaporator. The air-conditioning apparatus is configured to suck, compress, and discharge refrigerant repeatedly by the compressor. Through repeated operation of the air-conditioning apparatus, the refrigerant is discharged in a pulsed manner, with the result that pressure of the refrigerant fluctuates. This phenomenon is called a pressure pulsation. There is a problem in that the pressure pulsation may be transmitted from the compressor through a discharge pipe of the compressor to an indoor-side heat exchanger, and cause resonance with the structure of the indoor-side heat exchanger, resulting in generation of noise. This noise is referred to as a pulsation noise.

Thus, in the refrigerant circuit of the air-conditioning apparatus, a muffler is mounted to a pipe extending from a discharge port of the compressor to the indoor-side heat exchanger to reduce the pulsation noise.

When basic characteristics of the muffler are taken into account, in order to enhance a muffling effect, a cross sectional area ratio of an expansion chamber of a muffler main body to a pipe connected to a muffler main body needs to be set large. In view of such circumstance, for example, there has been proposed a muffler employing a configuration in which an inner diameter of the muffler main body is set large so that the muffling effect is enhanced when the cross sectional area of the pipe is fixed (see, for example, Patent Literature 1).

Further, in order to achieve downsizing of the muffler, there has been proposed a muffler downsized by changing a length and a diameter of an insertion pipe inserted into the muffler main body (see, for example, Patent Literature 2). In the muffler according to Patent Literature 2, a muffling property is enhanced by reducing an inner diameter of an inlet pipe connected to an inlet of the muffler main body before the inlet pipe enters the muffler main body, and by positioning a distal end of a portion of the inlet pipe, which is inserted into the muffler main body, at a center of the muffler main body.

CITATION LIST

Patent Literature

Patent Literature 1: Japanese Unexamined Patent Application Publication No. Hei 9-203386 (Page 2, Page 3, and FIG. 7)

Patent Literature 2: Japanese Unexamined Patent Application Publication No. 2011-12869 (Page 2 and FIG. 2)

SUMMARY OF INVENTION

Technical Problem

In the muffler proposed in Patent Literature 1, in order to enhance the muffling effect, the cross sectional area ratio of the expansion chamber of the muffler main body to the pipe connected to the muffler main body needs to be set large. Thus, there is a problem in that, when the inner diameter of the pipe connected to the muffler main body cannot be changed, the inner diameter of the muffler main body may disadvantageously increase.

In the muffler proposed in Patent Literature 2, in order to downsize the muffler while the muffling effect is maintained, an inner diameter of the inlet pipe is reduced also before the portion which is inserted into the muffler main body, and a length of an inserted pipe portion which is inserted into the muffler main body is set large to reach the vicinity of the center of the muffler main body. However, there is a problem in that a pressure loss of the refrigerant may increase.

The present invention has been made to solve the above-mentioned problems, and an object of the present invention is to obtain a muffler for an air-conditioning apparatus, which is downsized and has an enhanced muffling effect while the pressure loss of the refrigerant is suppressed to maintain efficiency of a heat exchange, and an air-conditioning apparatus including the muffler for an air-conditioning apparatus.

Solution to Problem

According to one embodiment of the present invention, there is provided a muffler for an air-conditioning apparatus, including: a tubular muffler main body which has small diameter portions on an inlet side and an outlet side, the small diameter portions having inner diameters smaller than an inner diameter of a central portion of the tubular muffler main body; an inlet pipe connected to the small diameter portion on the inlet side of the tubular muffler main body; and an outlet pipe connected to the small diameter portion on the outlet side of the tubular muffler main body, in which the inlet pipe is inserted into the tubular muffler main body, and has a distal end positioned at a center of a length from an inlet to an outlet of the tubular muffler main body, and in which the distal end side of the inlet pipe inserted into the tubular muffler main body has an inner diameter smaller than an inner diameter of the inlet pipe on upstream of the distal end side.

Advantageous Effects of Invention

According to the muffler for an air-conditioning apparatus of one embodiment of the present invention, the pressure loss of the refrigerant can be suppressed to be smaller than that of the related art while the muffling effect is maintained without increasing a size of the muffler main body, by positioning the distal end of the inlet pipe at the center of the length from the inlet to the outlet of the muffler main body and by setting the inner diameter of the inlet pipe on the distal end portion side smaller than the inner diameter of the inlet pipe on upstream of the distal end side.

DESCRIPTION OF EMBODIMENTS

Embodiment 1

Figure 1:
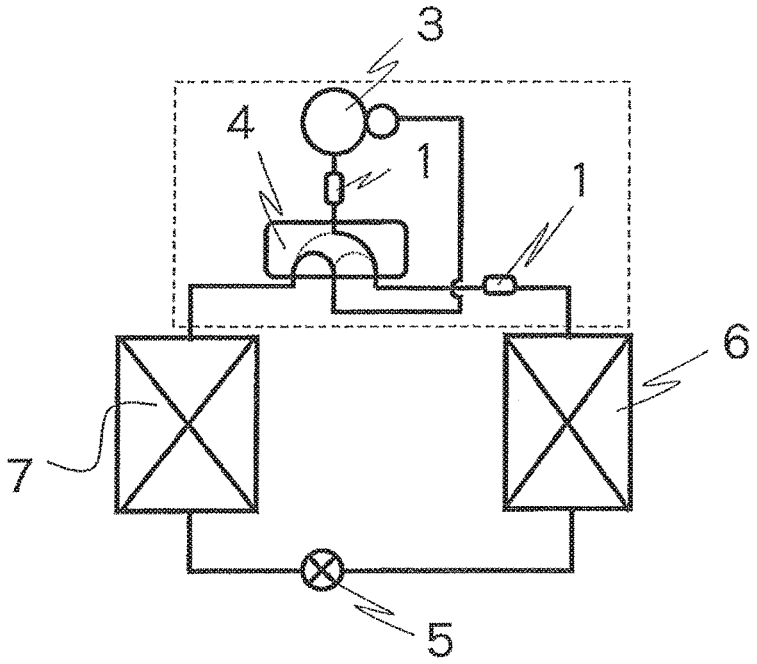
FIG. 1 is a refrigerant circuit diagram for illustrating an air-conditioning apparatus during a heating operation according to Embodiment 1 of the present invention.

FIG. 1 is a refrigerant circuit diagram for illustrating an air-conditioning apparatus during a heating operation according to Embodiment 1 of the present invention. In FIG. 1, a four-way valve 4 is switched to the heating operation (see the solid line of FIG. 1). During the heating operation, a compressor 3, the four-way valve 4, an indoor heat exchanger 6, an expansion valve 5, an outdoor heat exchanger 7, and the four-way valve 4 are annularly connected through refrigerant pipes. Mufflers 1 are mufflers for an air-conditioning apparatus, and are connected to a refrigerant pipe extending from a discharge port of the compressor 3 to the four-way valve 4, and connected to a refrigerant pipe extending from the four-way valve 4 to the indoor heat exchanger 6. During the heating operation, the indoor heat exchanger 6 positioned on a discharge port side of the compressor 3 functions as a condenser to perform the heating operation.

Figure 2:
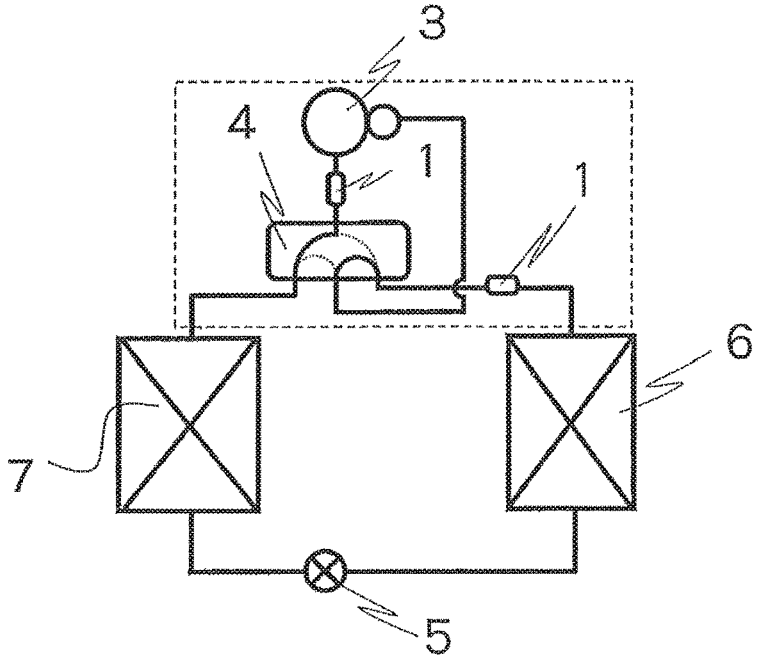
FIG. 2 is a refrigerant circuit diagram for illustrating the air-conditioning apparatus during a cooling operation according to Embodiment 1 of the present invention.

FIG. 2 is a refrigerant circuit diagram for illustrating the air-conditioning apparatus during a cooling operation according to Embodiment 1 of the present invention. In FIG. 2, the four-way valve 4 is switched to the cooling operation (see the solid line of FIG. 2). During the cooling operation, the compressor 3, the four-way valve 4, the outdoor heat exchanger 7, the expansion valve 5, the indoor heat exchanger 6, and the four-way valve 4 are annularly connected through the refrigerant pipes. The Mufflers 1 are connected to the refrigerant pipe extending from the discharge port of the compressor 3 to the four-way valve 4, and connected to the refrigerant pipe extending from the indoor heat exchanger 6 to the four-way valve 4. During the cooling operation, the indoor heat exchanger 6 positioned on downstream of the expansion valve 5 functions as an evaporator to perform the cooling operation.

Figure 3:
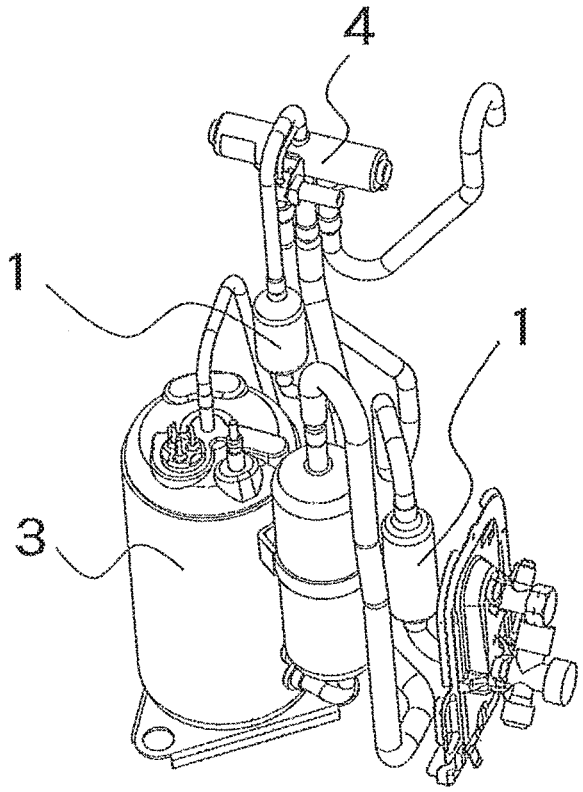
FIG. 3 is an external view for illustrating a part of the refrigerant circuit of FIG. 1 and FIG. 2, which is surrounded by the dotted line.

FIG. 3 is an external view for illustrating a part of the refrigerant circuit of FIG. 1 and FIG. 2, which is surrounded by the dotted line. Illustration is made of the mufflers 1, the compressor 3, the four-way valve 4, and the refrigerant pipes connecting those devices, which construct the air-conditioning apparatus.

Figure 4:
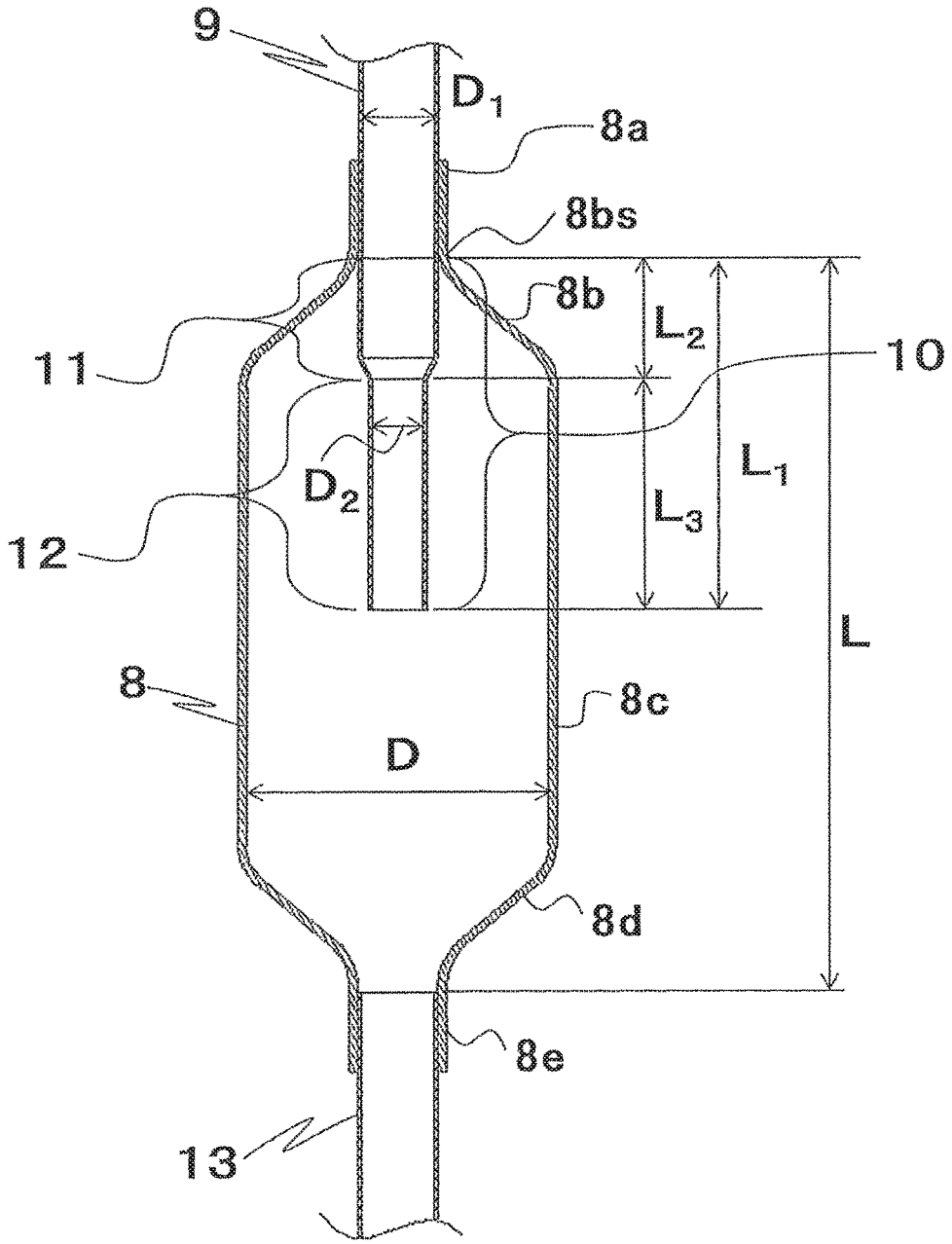
FIG. 4 is a sectional view for illustrating a muffler for the air-conditioning apparatus of FIG. 1 to FIG. 3.

FIG. 4 is a sectional view for illustrating the muffler 1 of FIG. 1 to FIG. 3. As is apparent from the descriptions of FIG. 1 and FIG. 2, the muffler 1 is mounted to the refrigerant circuit of the air-conditioning apparatus, at least to the refrigerant pipe connected to the discharge port side of the compressor 3. The muffler 1 includes a muffler main body 8, an inlet pipe 9, and an outlet pipe 13. The muffler main body 8 is constructed of a tubular body in which an inlet small diameter portion 8*a* is connected through an enlarged diameter portion 8*b* to a large diameter portion 8*c*, and the large diameter portion 8*c* is connected through a reduced diameter portion 8*d* to an outlet small diameter portion 8*e*. The inlet pipe 9 is connected to the inlet small diameter portion 8*a* of the muffler main body 8. The outlet pipe 13 is connected to the outlet small diameter portion 8*e* of the muffler main body 8.

The inlet pipe 9 is inserted through the inlet small diameter portion 8*a* of the muffler main body 8 into the muffler main body 8, and has an inserted pipe portion 10 having a length $L_1$ from a starting point 8*bs* of the enlarged diameter portion 8*b* of the muffler main body 8. A distal end of the inserted pipe portion 10 is positioned at a center of a length from an inlet to an outlet of the muffler main body 8. The inserted pipe portion 10 has an upper inserted pipe portion 11 and a lower inserted pipe portion 12. The upper inserted pipe portion 11 is a portion of a length $L_2$ from the starting point 8*bs* of the enlarged diameter portion 8*b* of the muffler main body 8. The upper inserted pipe portion 11 has an inner diameter equal to that of an upstream portion of the inlet pipe 9 with respect to the inlet small diameter portion 8*a* of the main body 8. The lower inserted pipe portion 12 is a portion of a length $L_3$, which is continuous with the upper inserted pipe portion 11. The inner diameter of the lower inserted pipe portion 12 is set smaller than that of the upper inserted pipe portion 11. Thus, as the inlet pipe 9, there is employed a refrigerant pipe reduced in diameter at a portion of the lower inserted pipe portion 12.

In the muffler 1 having the configuration described above, a ratio of an inner diameter D of the muffler main body 8 to an inner diameter $D_2$ of the lower inserted pipe portion 12 is set to satisfy $D/D_2>5.7$.

A length of the inserted pipe portion 10 is represented by $L_1$. A length of the upper inserted pipe portion 11 of the inserted pipe portion 10 is represented by $L_2$. A length of the lower inserted pipe portion 12 of the inserted pipe portion 10 is represented by $L_3$. The relationship among those lengths is set to satisfy $1.5<L_3/L_2<3$.

As in the related-art muffler according to Patent Literature 1, there is a problem in that, when a diameter of the inserted pipe portion 10 is reduced from the inlet (corresponding to the starting point 8*bs* of this embodiment) of the muffler main body 8 (that is, $L_2=0$ in this embodiment), a pressure loss of the refrigerant in the refrigerant circuit may increase, with the result that a heat exchange efficiency of the air-conditioning apparatus may be lowered. However, in this embodiment, the ratio of the inner diameter D of the muffler main body 8 to the inner diameter $D_2$ of the lower inserted pipe portion 12 is set to satisfy $D/D_2>5.7$, and a ratio of the length of the lower inserted pipe portion 12 to the length of the upper inserted pipe portion 11 is set to satisfy $1.5<L_3/L_2<3$. Thus, compared to the muffler in which the diameter of the inserted pipe portion 10 is reduced from the inlet of the muffler main body 8 as in Patent Literature 1, the pressure loss can be reduced by 66% to a maximum. In this comparison, both of this embodiment and Patent Literature 1 have the same values in the length L of the muffler main body 8, the inner diameter D of the muffler main body 8, the length $L_1$ of the inserted pipe portion 10, and the inner diameter $D_1$ of the inlet pipe 9. For example, in a general compact muffler for an air-conditioning apparatus, the inner diameter D of the muffler main body 8 is 28 mm to 32 mm, the length L of the muffler main body 8 is 60 mm to 100 mm, and the length $L_1$ of the inserted pipe portion 10 is 30 mm to 50 mm. In the muffler having the dimensions within those ranges, when the ratio of the inner diameter D of the muffler main body 8 to the inner diameter $D_2$ of the lower inserted pipe portion 12 is a fixed value, the ratio of the length $L_3$ of the lower inserted pipe portion 12 to the length $L_2$ of the upper inserted pipe portion 11, which can be manufactured, satisfies $1.5<L_3/L_2<3$. Under such a condition, when the pressure loss of the muffler in this embodiment is compared to that of the muffler having the inserted pipe portion 10 reduced in diameter from the inlet of the muffler main body 8, it is verified that the pressure loss is reduced by 33% to 66%. In the general compact muffler for an air-conditioning apparatus, as the ratio of the inner diameter D of the muffler main body 8 to the inner diameter $D_2$ of the lower inserted pipe portion 12 increases within a range of $5.7<D/D_2$, a muffling effect is enhanced. However, in that case, the pressure loss increases. Meanwhile, when the ratio of the length $L_3$ of the lower inserted pipe portion 12 to the length $L_2$ of the upper inserted pipe portion 11 is set to satisfy $L_3/L_2=1.5$, the pressure loss can be reduced by 66%. Therefore, even when the ratio $D/D_2$ of the inner diameter D of the muffler main body 8 to the inner diameter $D_2$ of the lower inserted pipe portion 12 is set to be as large as 6.7, there can be obtained a muffler having the pressure loss equivalent to that of the muffler in which the diameter of the inserted pipe portion 10 is reduced from the inlet of the muffler main body 8 while $D/D_2=5.7$ is satisfied.

Further, regarding the muffling effect of the mufflers 1, as the ratio of the inner diameter D of the muffler main body 8 to the inner diameter $D_2$ of the lower inserted pipe portion 12 increases, a muffling amount increases. Therefore, when the ratio is set to satisfy $D/D_2>5.7$ as described above, the muffling effect is enhanced. Here, when a refrigerant pipe in which a distal end side of the inserted pipe portion 10 is not reduced in diameter is employed as in the another related-art muffler (that is, $L_3=0$ in this embodiment), it is verified that, in order to obtain the muffling effect as in this embodiment, the inner diameter of the muffler main body 8 needs to be set about 1.3 times larger than that of this embodiment. That is, in this embodiment, the muffling effect can be enhanced by reducing the inner diameter of the lower inserted pipe portion 12 without increasing the size of the muffler main body 8. Therefore, when the muffler 1 of this embodiment is employed, the muffler for an air-conditioning apparatus having an enhanced muffling effect can be introduced into an existing air-conditioning apparatus without newly designing a configuration of refrigerant circuit pipes of the air-conditioning apparatus.

Next, description is made of calculation results of the muffling effect of the muffler for an air-conditioning apparatus, which are calculated with the following conditions using an acoustic impedance.

the inner diameter D of the muffler main body=32 mm, the inner diameter of the inserted pipe portion $$D_1=D_2,\ D/D_2=4.2 \quad (1)$$

the inner diameter D of the muffler main body=32 mm, the inner diameter of the inserted pipe portion $$D_1>D_2,\ D/D_2=5.8 \quad (2)$$

the inner diameter D of the muffler main body=44.1 mm, the inner diameter of the inserted pipe portion $$D_1=D_2,\ D/D_2=5.8 \quad (3)$$

Figure 5:
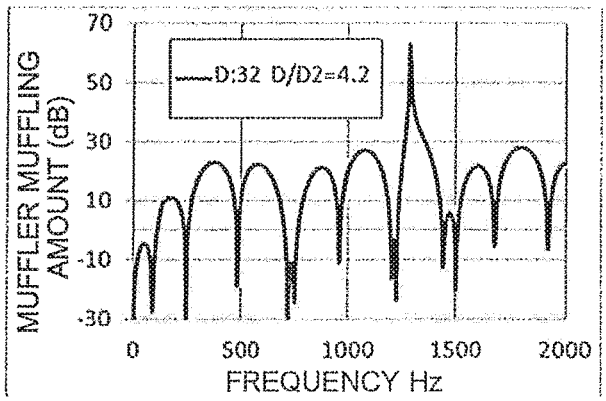
FIG. 5 is a graph (Comparative Example 1) for showing a muffling property of the muffler for an air-conditioning apparatus when a diameter of a lower inserted pipe portion is not reduced.
Figure 6:
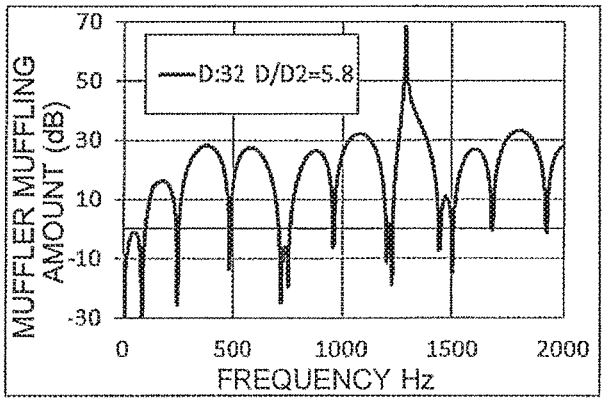
FIG. 6 is a graph (Example) for showing a muffling property of the muffler for an air-conditioning apparatus when a diameter of the lower inserted pipe portion is reduced.
Figure 7:
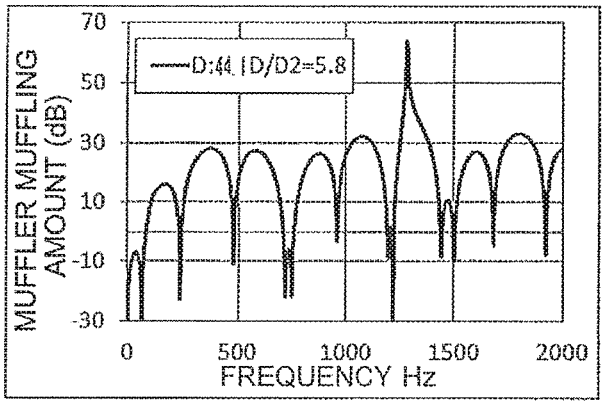
FIG. 7 is a graph (Comparative Example 2) for showing a muffling property of the muffler for an air-conditioning apparatus when a diameter of the lower inserted pipe portion is reduced.

FIG. 5 to FIG. 7 are graphs for showing muffling properties of the mufflers for an air-conditioning apparatus of the above-mentioned conditions (1) to (3). The calculation results of the muffling property are determined with certain conditions of the length L of the muffler main body 8, the length $L_1$ of the inserted pipe portion 10, the length $L_2$ of the upper inserted pipe portion 11, the inner diameter $D_1$ of the upper inserted pipe portion 11, and the length $L_3$ of the lower inserted pipe portion 12. Specifically, the mufflers for an air-conditioning apparatus of the conditions (1) to (3) satisfy the length L of the muffler 1=92 mm, the length $L_1$ of the inserted pipe portion 10=46 mm, and the inner diameter $D_1$ of the upper inserted pipe portion 11=7.6 mm. The muffler for an air-conditioning apparatus of the condition (2) satisfies the length $L_2$ of the upper inserted pipe portion=16 mm, and the length $L_3$ of the lower inserted pipe portion=30 mm.

FIG. 5 is a graph for showing the muffling property of the muffler for an air-conditioning apparatus of the above-mentioned condition (1). In the muffler for an air-conditioning apparatus of the above-mentioned condition (1), the inner diameter $D_1$ of the upper inserted pipe portion 11 and the inner diameter $D_2$ of the lower inserted pipe portion 12 are equal.

FIG. 6 is a graph for showing the muffling property of the muffler for an air-conditioning apparatus of the above-mentioned condition (2). The muffler for an air-conditioning apparatus of the above-mentioned condition (2) satisfies $D/D_2=5.8$ by reducing the inner diameter $D_2$ of the lower inserted pipe portion 12 as compared to the muffler for an air-conditioning apparatus of the above-mentioned condition (1). When the calculation results of the muffling property in the cases of the above-mentioned condition (1) and the above-mentioned condition (2) are compared, it is found that the muffling amount increases without fluctuation of a frequency having the muffling effect. In addition, it is also found that the muffling effect is improved by about 8 dB to a maximum (see FIG. 5 and FIG. 6). That is, when $D/D_2>5.7$ is satisfied as in the muffler for an air-conditioning apparatus of the above-mentioned condition (2), sufficient muffling effect can be obtained as compared to the case of the above-mentioned condition (1).

FIG. 7 is a graph for showing the muffling property of the muffler for an air-conditioning apparatus of the above-mentioned condition (3). The muffler for an air-conditioning apparatus of the above-mentioned condition (3) is set to satisfy $D/D_2=5.8$ by increasing the inner diameter D of the muffler main body 8 without changing the inner diameter $D_2$ of the lower inserted pipe portion 12. When the calculation result of the muffling property in the case of the above-mentioned condition (3) is compared to the calculation result of the muffling property in the case of the above-mentioned condition (2), the muffling effects are substantially the same. That is, the muffling effect can be enhanced by reducing the inner diameter $D_2$ of the lower inserted pipe portion 12 without increasing the diameter of the muffler main body 8.

<Evaluation with Air-Conditioning Apparatus>

Figure 8:
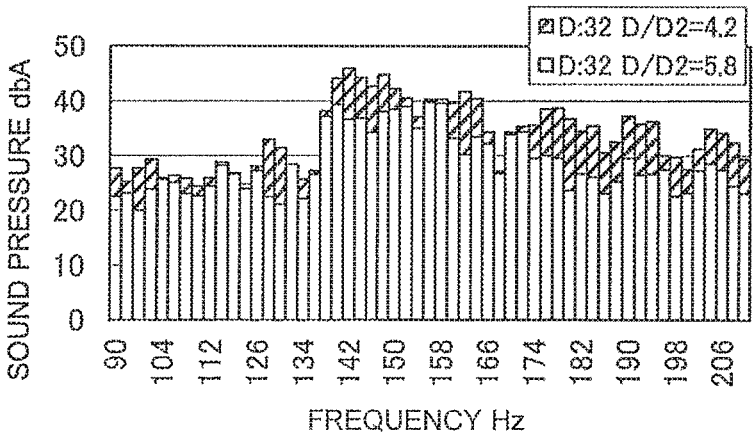
FIG. 8 is a graph for showing measurement results (Comparative Example 1 and Example) of a pulsation noise of an air-conditioning apparatus arranged at a discharge port of a compressor for the cases of the muffler for an air-conditioning apparatus having the lower inserted pipe portion reduced in diameter and the muffler for an air-conditioning apparatus having the lower inserted pipe portion not reduced in diameter.

FIG. 8 is a graph for showing the measurement results, with the mufflers for an air-conditioning apparatus of the above-mentioned conditions (1) and (2) each arranged on the discharge side of the compressor 3 in order to verify the efficacy of the muffling effect described above. A pulsation noise generated in the indoor heat exchanger due to a pressure pulsation is measured. When a comparison is made between a measurement result of the muffler for an air-conditioning apparatus as a reference and a measurement result of the muffler for an air-conditioning apparatus in which the inner diameter $D_2$ of the lower inserted pipe portion 12 is reduced, it is found that the pulsation noise is reduced. From this point of view, it is found that the high muffling effect can be obtained when an inner diameter ratio is set to satisfy $D/D_2>5.7$.

REFERENCE SIGNS LIST

1 muffler (for air-conditioning apparatus) 3 compressor 4 four-way valve 5 expansion valve 6 indoor heat exchanger 7 outdoor heat exchanger 8 muffler main body 8*a* inlet small diameter portion 8*b* enlarged diameter portion 8*bs* starting point of enlarged diameter portion 8*c* large diameter portion 8*d* reduced diameter portion 8*e* outlet small diameter portion 9 inlet pipe 10 inserted pipe portion 11 upper inserted pipe portion 12 lower inserted pipe portion 13 outlet pipe

The invention claimed is:

1. A muffler for an air-conditioning apparatus, comprising:

a muffler main body, having a tubular shape, in which a relatively small diameter inlet portion is connected to a relatively large diameter portion through an enlarged diameter portion, and the relatively large diameter portion is connected to a relatively small diameter outlet portion through a reduced diameter portion, wherein the relatively small diameter inlet portion and the relatively small diameter outlet portion are relatively small in comparison to the relatively large diameter portion, and the relatively large diameter portion is relatively large in comparison to the relatively small diameter inlet portion and the relatively small diameter outlet portion;

an inlet pipe connected to the relatively small diameter inlet portion of the muffler main body; and an outlet pipe connected to the relatively small diameter outlet portion of the muffler main body, wherein the inlet pipe has an inserted pipe portion disposed in the muffler main body, and the inserted pipe portion is inserted into the muffler main body from the relatively small diameter inlet portion and extends from a starting point of the enlarged diameter portion to an inside of the muffler main body, the inserted pipe portion has an upper inserted pipe portion positioned on an inlet side of the muffler main body and a lower inserted pipe portion positioned on an outlet side of the upper inserted pipe portion, the lower inserted pipe portion has a distal end positioned at a center of a length from an inlet to an outlet of the muffler main body, and the lower inserted pipe portion has an inner diameter that is smaller than an inner diameter of the upper inserted pipe portion, the upper inserted pipe portion has a uniform diameter section, and the lower inserted pipe portion has a uniform diameter section, and there is a tapered section between the uniform diameter section of the upper inserted pipe portion and the uniform diameter section of the lower inserted pipe portion, the uniform diameter section of the upper inserted pipe portion extends beyond the relatively small diameter inlet portion in the direction of the relatively small diameter outlet portion, and a length of the upper inserted pipe portion, which includes the tapered section, is defined as $L_2$, and a length of the lower inserted pipe portion is defined as $L_3$, and a ratio of $L_2$ to $L_3$ is set to satisfy $1.5<L_3/L_2<3$.

2. The muffler for an air-conditioning apparatus of claim 1, wherein a ratio of an inner diameter D of the muffler main body to an inner diameter $D_2$ of the lower inserted pipe portion is set to satisfy $D/D_2>5.7$.

3. An air-conditioning apparatus, comprising:

a compressor, a condenser, an expansion valve, and an evaporator, connected, through refrigerant pipes, in a refrigerant circuit; and the muffler of claim 1, wherein the muffler is positioned at least on a discharge port side of the compressor.

4. The muffler for an air-conditioning apparatus of claim 1, wherein the inner diameter of the upper inserted pipe portion is equal to an inner diameter of the inlet pipe upstream of the relatively small diameter inlet portion.

* * * * *